US005078321A

United States Patent [19]

Davis et al.

[11] Patent Number: 5,078,321

[45] Date of Patent: Jan. 7, 1992

[54] ROTARY ATOMIZER CUP

[75] Inventors: Dennia Davis, Bay Village; Harold D. Beam, Oberlin, both of Ohio

[73] Assignee: Nordson Corporation, Westlake, Ohio

[21] Appl. No.: 542,167

[22] Filed: Jun. 22, 1990

[51] Int. Cl.[5] ..... B05B 3/10

[52] U.S. Cl. ..... 239/224; 239/703

[58] Field of Search ..... 239/223, 224, 700, 701, 239/702, 703

[56] References Cited

U.S. PATENT DOCUMENTS

| | | | |
|---|---|---|---|
| 1,236,073 | 8/1917 | Fesler . | |
| 2,214,568 | 9/1940 | Thomas . | |
| 2,893,894 | 7/1959 | Ransburg . | |
| 3,121,533 | 2/1964 | Sedlacsik, Jr. . | |
| 3,840,328 | 10/1974 | Ashton . | |
| 3,990,854 | 11/1976 | Dahmen . | |
| 4,148,932 | 4/1979 | Tada et al. . | |
| 4,361,287 | 11/1982 | Morishita et al. . | |
| 4,369,924 | 1/1983 | Morishita et al. . | |
| 4,376,135 | 3/1983 | Patel et al. . | |
| 4,381,079 | 4/1983 | Allen . | |
| 4,423,840 | 1/1984 | Coeling . | |
| 4,429,833 | 2/1984 | Meisner et al. | 239/224 |
| 4,458,844 | 7/1984 | Mitsui . | |
| 4,518,119 | 5/1985 | Vetter . | |
| 4,519,549 | 5/1985 | Yokoe et al. . | |
| 4,555,058 | 11/1985 | Weinstein et al. . | |
| 4,572,437 | 2/1986 | Huber et al. . | |
| 4,605,168 | 8/1986 | Tachi et al. | 239/223 |
| 4,643,357 | 2/1987 | Culbertson et al. . | |
| 4,776,520 | 10/1988 | Merritt . | |
| 4,784,332 | 11/1988 | Takeuchi et al. . | |
| 4,844,348 | 7/1989 | Rutz | 239/703 |
| 4,854,500 | 8/1989 | Mathai et al. . | |
| 4,887,770 | 12/1989 | Wacker et al. . | |
| 4,899,936 | 2/1990 | Weinstein . | |
| 4,928,883 | 5/1990 | Weinstein . | |
| 4,936,510 | 6/1990 | Weinstein | 239/223 |

FOREIGN PATENT DOCUMENTS

| | | |
|---|---|---|
| 493733 | 6/1953 | Canada . |
| 216173 | 1/1987 | European Pat. Off. . |

*Primary Examiner*—Andres Kashnikow
*Assistant Examiner*—Christopher G. Trainor
*Attorney, Agent, or Firm*—Wood, Herron & Evans

[57] ABSTRACT

An atomizing bell or cup for use in a rotary atomizing apparatus includes a generally frusto-conical-shaped wall having an outer surface and an inner flow surface which terminates at an annular atomizing lip. A plurality of radially outwardly extending fins or ribs are formed on the inner flow surface of the cup upstream from the atomizing lip which are circumferentially spaced from one another to provide flow paths therebetween for coating material flowing along the interior surface of the cup such that the coating material is divided into a number of individual streams before reaching the atomizing lip. These streams are emitted from between adjacent ribs a short distance upstream from the atomizing lip which allows centrifugal force to at least partially flatten the streams forming ribbon-shaped streams, which, when flung outwardly from the atomizing lip, form completely atomized coating particles which are substantially free of air bubbles.

22 Claims, 2 Drawing Sheets

ROTARY ATOMIZER CUP

FIELD OF THE INVENTION

This invention relates to rotary atomizing liquid spray coating apparatus, and, more particularly, to a rotary atomizing apparatus having an atomizing cup which substantially eliminates the formation of entrapped air in the atomized coating particles discharged from the cup.

BACKGROUND OF THE INVENTION

Rotary atomizers are one type of apparatus used commercially to apply liquid coating materials in atomized form onto substrates. Apparatus of this type generally include an atomizing cup, a motor for rotating the atomizing cup at high speeds, a source of liquid coating material such as paint which is delivered to the atomizing cup, and, in some applications, a high voltage power source for applying an electrostatic charge to the atomized paint particles. Liquid coating material is delivered to the interior of the atomizing cup and flows along its inner wall under the application of centrifugal force. When the coating material reaches the peripheral edge or atomizing lip of the cup, it is flung radially outwardly to form atomized particles of coating material. In recent years, the trend has been to increase the speed of rotation of the atomizing cup to speeds on the order of 10,000 rpm to 40,000 rpm, or higher, in order to effectively atomize liquid coatings which are normally difficult to atomize, and to increase the quantity of coating material which can be atomized by a single rotary atomizer.

One problem which has been encountered with rotary atomizers of the type described above is that foam or bubbles in the atomized coating particles can be created, particularly at high speeds of operation. The presence of foam or bubbles in the atomized particles causes defects in the coating applied to a substrate, such as a roughened appearance and/or a haze that destroys the gloss on the substrate surface. It is theorized that such defects result from the production of entrapped air in at least some of the atomized coating particles which causes these particles to foam.

This problem has been addressed in high speed rotary atomizers of the type disclosed in U.S. Pat. Nos. 4,148,932 and 4,458,844. These patents are directed to rotary atomizers having an atomizing bell or cup formed with a plurality of grooves or notches near the peripheral edge of the cup which extend in a radial direction and increase in depth in the direction of the flow of coating material along the inside surface of the cup. These grooves divide the flow of coating material into separate streams, as opposed to an essentially continuous sheet of coating material on the inside surface of the cup. It has been found that such individual streams are more readily atomized without the formation of entrapped air in the atomized particles, and thus produce a more acceptable coating on a target substrate.

One problem with apparatus such as disclosed in U.S. Pat. Nos. 4,148,932 and 4,458,844 is that radial grooves reduce the structural integrity of the peripheral edge of the atomizing bell or cup. As a result, the cup can be relatively easily damaged during use. Another problem with such apparatus is that complete separation of the coating material into individual streams may not be obtained, particularly at relatively high flow rates of the coating material. The construction of the atomizing bell or cup as disclosed in U.S. Pat. Nos. 4,148,932 and 4,458,844 results in the formation of areas of the inside surface of the cup, between adjacent radial grooves, which are in the same plane as the flow of coating material along the cup surface. While much of the coating material flows into the grooves for separation into streams, some of the coating material might nevertheless continue to flow along the areas of the inside of the cup between grooves and thus interfere with the formation of separated, individual streams of coating material for atomization.

A third potential problem with rotary atomizers of the type described in U.S. Pat. Nos. 4,148,932 and 4,458,844 above is pressure loss. As the coating material moves along the inside surface of the cup toward its peripheral edge, centrifugal force pressurizes the coating material. The sudden pressure drop which occurs when the coating material is flung from the atomizing lip of the cup atomizes the coating material, and the effectiveness of such atomization is at least partially dependent upon maintaining the coating material at high pressure up to the atomizing edge or lip. By forming grooves in the atomizing bell or cup upstream from the atomizing lip of the cup, a pressure loss occurs before the coating material is discharged from the atomizing lip which can adversely effect atomization.

SUMMARY OF THE INVENTION

It is therefore among the objectives of this invention to provide a rotatable atomizing bell or cup for use in a rotary atomizing apparatus, which effectively reduces or eliminates entrapped air or bubbles within atomized coating particles and which is rugged in construction.

These objectives are accomplished in an atomizing bell or cup for use in a rotary atomizing apparatus which includes a generally frusto-conical-shaped wall having an exterior surface and an interior surface formed with a coating flow surface which terminates at an annular atomizing lip. Liquid coating material such as paint is delivered to the interior flow surface of the atomizing cup and flows therealong toward the atomizing lip under the influence of centrifugal force. A plurality of fins or ribs extend radially outwardly from the interior flow surface of the cup and terminate upstream from its atomizing lip. These ribs are circumferentially spaced from one another about the periphery of the cup to provide flow paths therebetween for the coating material flowing along the interior surface of the cup such that the coating material is divided into a number of individual streams before reaching the atomizing lip. These streams of coating material are then flung outwardly from the atomizing lip of the cup to form atomized particles which are substantially free of air bubbles, which produces an acceptable coating on the surface of a substrate.

This invention is therefore predicated upon the concept of dividing the flow of coating material along the interior surface of the atomizing cup into a number of individual streams, which streams are formed by the space between adjacent, radially outwardly extending fins or ribs integrally formed with or connected to the interior surface of the cup. The individual streams are directed axially from between adjacent ribs to the atomizing lip over a relatively small axial space on the interior surface of the cup and its atomizing lip. It has been found that centrifugal force acts on the individual streams as they traverse this axial space, and before they are flung outwardly from the atomizing lip of the cup, causing such streams to become at least partially flattened in a ribbon-like, generally elliptical shape which can be more readily atomized to form particles without the presence of entrapped air.

In the presently preferred embodiment, each of the fins or ribs has an arcuate inner edge, an angled outer edge and a top surface extending between the inner and outer edges which is located at a radial distance of about 0.015 inches from the interior surface of the atomizing cup. Adjacent fins or ribs are preferably spaced about 0.010 inches from one another, and they have a thickness of about 0.020 inches each. Additionally, the fins or ribs each terminate at a distance of about 0.007 inches from the atomizing lip of the cup which, in the presently preferred embodiment, is convexly arcuate in shape.

In another aspect of this invention, it has been found that a partial vacuum is created on the exterior surface of the rotating, atomizing cup due to centrifugal force, and this vacuum tends to draw atomized coating material back toward the outside surface of the cup, particularly at high rotational speeds. In addition to applying unwanted coating material onto the forward portion of the rotary atomizing apparatus, this vacuum can disrupt the pattern of coating material applied to a substrate. In the presently preferred embodiment, air is directed onto the outside surface of the atomizing cup, toward its peripheral edge, which effectively breaks this vacuum and prevents the coating material from flowing in a reverse direction onto the outside surface of the cup.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 5:
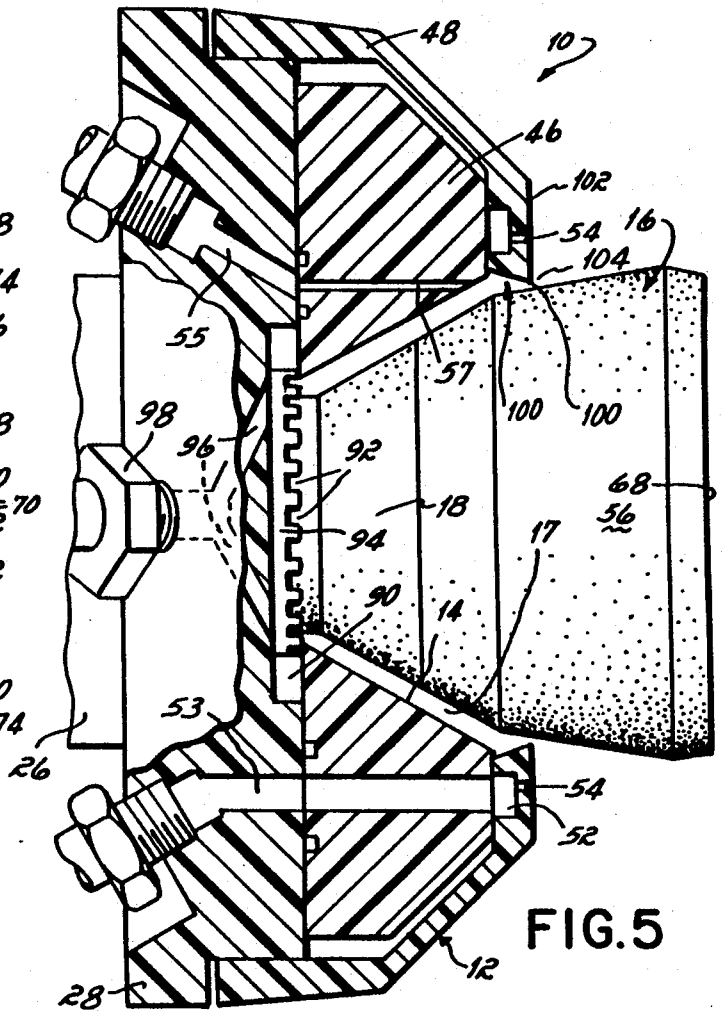
FIG. 5 is a view similar to FIG. 1, in partial perspective, which illustrates the structure for directing air onto the outside surface of the atomizing cup.
Figure 1:
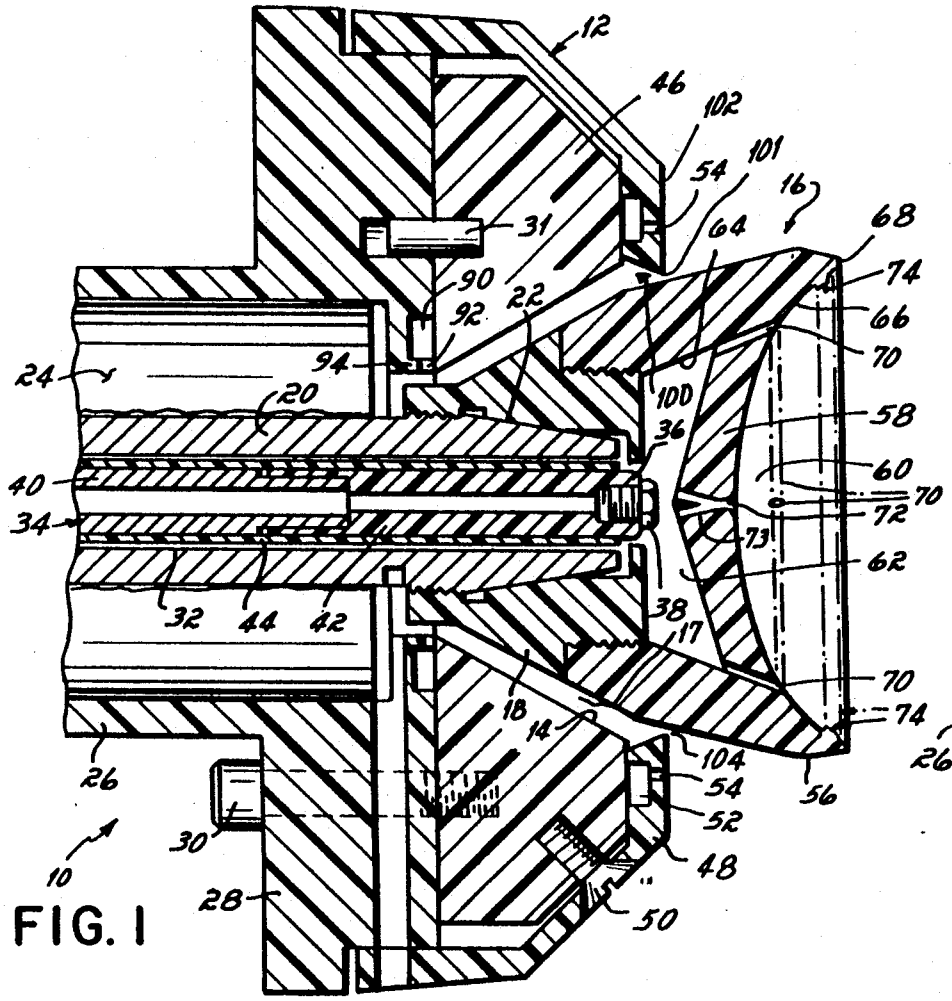
FIG. 1 is a cross sectional view of the forward portion of a rotary atomizer apparatus incorporating the atomizing cup of this invention.
Figure 2:
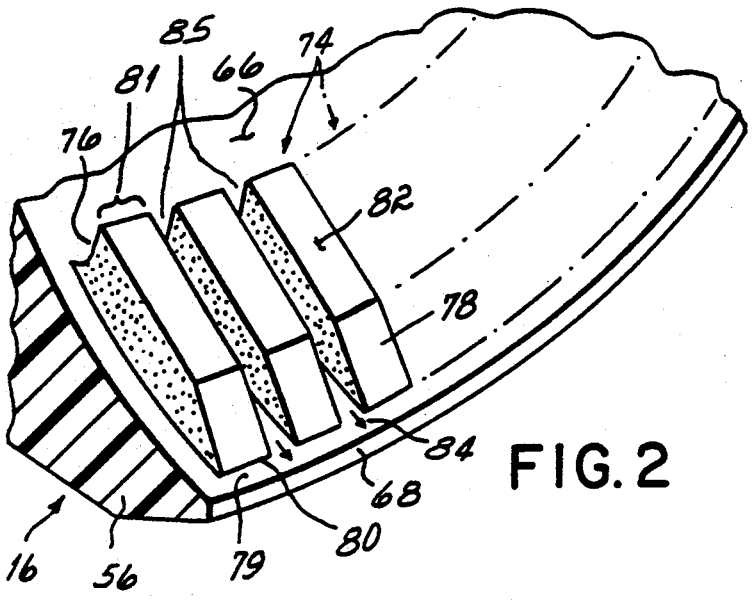
FIG. 2 is an enlarged view of a portion of the atomizing cup illustrating the radially outwardly extending fins or ribs mounted to the inner surface of the cup.

Referring to FIGS. 1 and 5, a forward portion of a rotary atomizer 10 is illustrated which is of the type disclosed in U.S. patent application Ser. No. 07/503,310, filed Mar. 30, 1990 by Wacker et al, which is owned by the assignee of this invention and the disclosure of which is incorporated by reference in its entirety herein. The structure of the rotary atomizer 10 apart from that portion illustrated in the Figs. forms no part of this invention per se and is thus not discussed herein.

The rotary atomizer 10 mounts a cap assembly 12 including a tapered central recess 14 from which a rotary atomizer head in the form of a cup 16 extends. A substantially annular space or flow passage 17 is formed between the wall of recess 14 and the exterior surface of cup 16. The cup 16, described in further detail hereinafter, includes a base 18 which is threadably secured to a shaft 20 having a frusto-conical portion 22. The shaft 20 extends from a motor 24 which rotates cup 16 at high speed. Motor 24 preferably comprises an air driven type turbine which includes internal air bearings, a driving air inlet and a braking air inlet for controlling the rotation of cup 16, all of which components are well known in the art and do not form a part of the invention. The motor 24 is received within a motor housing 26 which is preferably formed of an electrically non-conductive material. Motor housing 26 has a forward end 28 secured to cap assembly 12 by screws 30. A locator pin 31 extends between aligning bores formed in the forward end 28 of motor housing 26 and cap assembly 12 to ensure proper alignment of these two elements prior to assembly.

Motor 24 is also formed with a bore 32 which traverses the entire length of motor 24 and shaft 20. This bore 32 receives a coating material feed tube 34 having an end 36 which communicates with the interior of cup 16 and which carries a nozzle 38. The feed tube 34 preferably has a first portion 40 formed of a rigid material such as stainless steel and a second portion 42 formed of an electrically non-conductive material. First and second portions 40, 42 are preferably covered with a layer of heat-shrinkable tubing 44. The shaft 20 extends from the rear of motor 24, which it is secured to turbine blades (not shown), out through the front of the motor 24 where the cup 16 is threadably secured thereto as previously described.

The cap assembly 12 includes a generally circular plate 46 which mates flush with the forward end 28 of motor housing 26, and is positionally located with respect thereto by means of the locator pin 31 mentioned above. An electrically non-conductive cover 48 is connected to the plate 46 by means of a plurality of flat head screws 50. Cover 48 includes an annular groove 52 intersected by a plurality of small air ports 54 each of which is oriented in a direction generally parallel to the axis of feed tube 34. Groove 52 is connected to an air line 53 which extends through the forward end 28 of motor housing 26 and plate 46 of cap assembly 12 as shown in FIG. 5. Pressurized air is transmitted through line 53 and into groove 52 to provide a plurality of air jets which are discharged from air ports 54 to assist in both shaping and propelling the spray of coating material discharged from the cup 16 as described below. Additionally, the motor housing 26 and plate 46 are formed with passages 55, 57, respectively, which transmit solvent to the exterior of cup 16 for cleansing.

In the preferred embodiment, the cup 16 is formed of the base portion 18 and a generally frusto-conical-shaped end cap 56. The base 18 is removably threaded to the shaft 20 of motor 24, while the end cap 56 is removably threaded to base 18. The interior of end cap 56 mounts a divider 58 which defines a forward cup cavity 60 and a rearward cup cavity 62. The nozzle 38 carried by the feed tube 34 is located within the rearward cup cavity 62 to receive coating material discharged therefrom. In the illustrated embodiment, divider 58 takes the form of a generally circular disk having a forward face which dishes inwardly toward its central portion. The peripheral portion of divider 58, at its rearward face, adjoins the inner surface 64 of rearward cup cavity 62, and, at its forward face, adjoins a coating material flow surface 66 formed by the inner surface of forward cup cavity 60. This flow surface 66 terminates at a generally convexly arcuate atomizing edge 68, described in more detail below.

The periphery of divider 58 includes a plurality of circumferentially spaced holes 70. Holes 70 have inlets adjacent the inner surface 64 of rearward cup cavity 62, and terminate adjacent the coating material flow surface 66 in forward cup cavity 60 thereby establishing flow paths through which most of the fluid entering rear cavity 62 from nozzle 38 makes its way to the coating material flow surface 66 which partially surrounds forward cup cavity 60. Additionally, the central portion of divider 58 is provided with a central opening 72 through which rearward cavity 62 can communicate with forward cavity 60. Preferably, opening 72 is formed of four separate, circumferentially spaced holes 73 which intersect near the forward face of divider 58 but which diverge away from the axis of feed tube 34 so that coating material discharged from nozzle 38 is not aimed directly into opening 72. Nevertheless, when atomizer 10 is in use, some coating material passes through opening 72 and flows along the forward face of divider 58 to keep that surface wetted rather than permitting any back spray which might otherwise accumulate thereon to dry.

Figure 3:
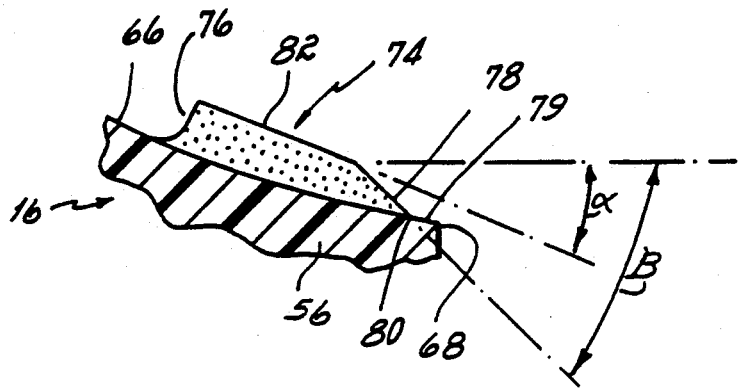
FIG. 3 is a side view of one of the ribs shown in FIG. 2.
Figure 4A:
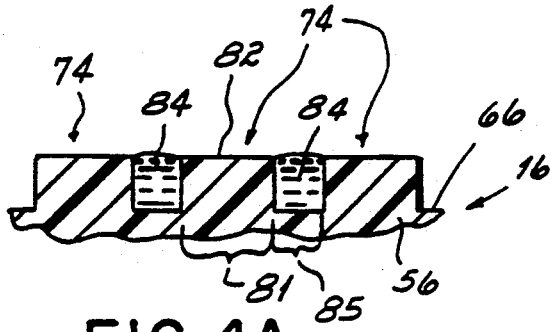
FIG. 4A is a partial cross sectional view of the peripheral edge of the atomizing cup illustrating coating material within the spaced ribs.
Figure 4B:
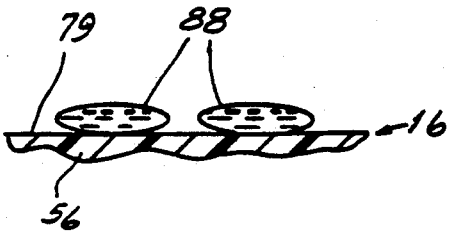
FIG. 4B is a view of the streams of coating material after discharge from between adjacent ribs but before atomization.

Referring now to FIGS. 1–4, an important aspect of this invention is the provision of a number of fins or ribs 74 which are mounted or integrally formed on the coating flow surface 66 of forward cup cavity 60 immediately upstream from the atomizing edge 68. These fins or ribs 74 project radially outwardly from the flow surface 66 to a maximum height of about 0.015 inches therefrom, and are circumferentially spaced at a distance 85 of about 0.010 inches from one another about the entire periphery of the forward cup cavity 60. As viewed in FIGS. 2 and 3, each fin or rib 74 includes an arcuate rearward edge 76 having a radius of about 0.015 inches, an angled forward edge 78 having a forwardmost end 80 at the coating flow surface 66 and an outer surface 82 which extends between the arcuate inner edge 76 and angled outer edge 78. The forwardmost end 80 of the angled forward edge 76 of each rib 74 terminates at a distance of about 0.007 inches from the atomizing edge 68 forming an axial space 79 therebetween along the flow surface 66. The total axial length of each rib 74, i.e., from its rearward edge 76 to the forwardmost end 80, is about 0.080 inches. In the presently preferred embodiment, the outer surface 82 of each rib 74 is angled radially inwardly relative to flow surface 66 at an angle $\alpha$ of about 23° as shown in FIG. 3. This radially inward angulation of the top surface 82 is such that the difference in vertical height from its rearward end to its forward end is in the range of about 0.010 to 0.016 inches. The outer edge 78 is angled radially inwardly toward the coating flow surface 66 at an angle $\beta$ of approximately 48°. This angulation of the outer edge 78 of rib 74 is such that the difference in vertical height from its rearward end to its forward end at the coating flow surface 66 is in the range of about 0.030 to 0.040 inches. Preferably, the thickness or circumferential width 81 of each fin or rib 74 as shown in FIG. 3 is about 0.020 inches.

As mentioned above, some rotary atomizer apparatus have suffered from the problem of producing atomized particles of coating material which contain at least some air bubbles. This can produce a foam on the surface of the substrate resulting in a roughened or otherwise unacceptable surface coating as described above. The purpose of the circumferentially spaced ribs 74 is to divide the coating material flowing along the coating flow surface 66 of forward cup cavity 60 into a plurality of individual streams 84 which remain in the same plane as flow surface 66 to avoid a pressure drop, and which can be atomized without the formation of air bubbles. See FIGS. 2 and 4A.

These individual streams 84 are formed by the space 85 between adjacent ribs 74 upstream from the rounded atomizing edge 68 formed at the outermost end of forward cup cavity 60. With the space 85 between adjacent fins or ribs 74, the individual streams 84 of coating material extend outwardly a given distance from the flow surface 66 of cup 16 along the walls formed by the ribs 74 at a radial distance which depends upon the flow rate of coating material within cup 16 and its speed of rotation. As mentioned above, the forwardmost edge 80 of each rib 74 terminates at an axial space 79 of about 0.007 inches from the atomizing edge 68. It has been found that this space or gap 79 between the ribs 74 and atomizing edge 68 allows centrifugal force to act on the individual streams 84 after they exit from between adjacent fins 74 but before they are flung from the atomizing edge 68. Centrifugal force at least partially flattens the streams 84 against the flow surface 66 to form ribbon-like, generally elliptical-shaped streams 88 which have a somewhat lesser radial height relative to flow surface 66 than streams 84 between the fins 74. See FIG. 4B. These flattened or elliptical-shaped streams 88 are then flung outwardly from the atomizing lip 68, and it has been found that such streams 88 atomize substantially without the formation of entrapped air bubbles in the atomized particles which can produce surface defects on a substrate as described above.

Referring now to FIG. 5, another aspect of this invention is illustrated. It has been found that rotation of the cup 16, particularly at high speeds, creates a partial vacuum within the flow passage 17 between the cup 16 and the wall of recess 14 in cap assembly 12. This partial vacuum tends to draw or suck atomized particles of coating material back around the outer periphery of the cup 16 toward the plate 46, and onto the exterior surface of cap assembly 12. Such reverse flow of atomized particles also disrupts or interferes with the pattern-shaping air discharged from ports 54 in the cover 48 of cap assembly 12, which can result in an unacceptable pattern of coating material on a substrate.

In order to break this vacuum, the forward end 28 of motor housing 26 is formed with an annular groove 90 which is connected to a plurality of notches or ports 92 formed in a ring 94 located at the forward face of the forward end 28 of motor housing 26. The annular groove 90 is connected by lines 96 through a fitting 98 to a source of pressurized air, such as the supply or exhaust (not shown) from the turbine or motor 24. The notches or ports 92 are oriented to direct jets of pressurized air, having a velocity proportional to the speed of operation of motor 24, into the flow passage 17 between the exterior surface of cup 16 and the wall of recess 14 toward the forwardmost end of cover 48. In the presently preferred embodiment, a radially inwardly extending, annular lip 100 having a tip 101 is mounted to the forwardmost end 102 of cover 48. As viewed in FIG. 5, the lip 100 tapers or angles inwardly in a forward direction so that the gap 104 between the lip 100 and the outer surface of cup 16 decreases to a minimum space or clearance at the tip 101 of the lip 100. Preferably, this minimum space or gap between the tip 101 and cup 104 is in the range of about 0.01 to 0.10 inches.

The jets of pressurized air directed into the recess 14 travel forwardly, and the lip 100 is effective to direct such air jets onto the outer surface of cup 16, and to accelerate such air jets at the forward end of cover 48. This has the effect of substantially eliminating the vacuum or negative pressure which tends to develop within recess 14, particularly at high rotational speeds of cup 16, and thus eliminates or at least reduces any back flow of atomized coating material onto the outer surface of cup 16. Such reduction or elimination of the back flow of atomized coating material permits the pattern-shaping air discharged from ports 54 to reach the atomized coating material emitted from cup 16 essentially unimpeded, so that the pattern of coating material applied to a substrate can be controlled even at high rotational speeds of cup 16.

While the invention has been described with reference to a preferred embodiment, it should be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof.

For example, the rotary atomizer 10 of this invention can be an electrostatic type adapted to impart an electrical charge to the liquid coating material just prior to its atomization. In this embodiment, the rotary atomizer is supplied with high voltage by a high voltage cable connected to one or more charging electrodes associated with the cap assembly 12 for imparting a charge to the coating material in the manner described in U.S. Pat. No. 4,887,770, which is commonly assigned to the assignee of this invention, the disclosure of which is incorporated by reference in its entirety herein.

Therefore, it is intended that the invention not be limited to the particular embodiment disclosed as the best mode contemplated for carrying out this invention, but that the invention will include all embodiments falling within the scope of the appended claims.

We claim:

1. A rotary atomizer cup for atomizing coating material comprising:

a rotatable cup body including a wall having an outer surface and an inner flow surface which terminates at an atomizing lip, said cup body being adapted to receive coating material which flows along said inner flow surface toward said atomizing lip;

a plurality of ribs each extending outwardly from said inner flow surface, said ribs being spaced from one another to divide the coating material flowing along said inner flow surface into a number of individual streams, said individual streams of coating material being discharged from said atomizing lip of said cup body to form atomized particles of coating material.

2. The rotary atomizer cup of claim 1 in which said ribs are spaced a distance of about 0.010 inches from one another.

3. The rotary atomizer cup of claim 1 in which said ribs are each about 0.020 inches in width.

4. The rotary atomizer cup of claim 1 in which said ribs each extend a distance of about 0.015 inches outwardly from said inner flow surface.

5. The rotary atomizer cup of claim 1 in which each of said ribs has a terminal end which is spaced about 0.007 inches upstream from said atomizing lip.

6. The rotary atomizer cup of claim 1 further including means for directing air along said outer surface of said cup body toward said atomizing lip.

7. A rotary atomizer cup for atomizing coating material, comprising:

a rotatable cup body including a wall having an outer surface and an inner flow surface having a forward end which terminates at an atomizing lip, said cup body being adapted to receive coating material which flows in a forward direction along said inner flow surface toward said atomizing lip;

a plurality of ribs each extending outwardly from said inner flow surface and having a forwardmost end spaced upstream from said atomizing lip, said ribs being spaced from one another to divide the coating material flowing along said inner flow surface into individual streams of coating material, said individual streams being discharged from between adjacent ribs and flowing to said atomizing lip to form atomized particles of coating material.

8. The rotary atomizer cup of claim 7 in which said forwardmost end of each said ribs is spaced about 0.007 inches from said atomizing lip.

9. Apparatus for atomizing coating material, comprising:

a housing carrying a motor;

a cup body carried by said housing and rotatably driven by said motor, said cup body including a wall having an outer surface and an inner flow surface which terminates at an atomizing lip, said cup body being adapted to receive coating material which flows along said inner flow surface toward said atomizing lip;

a plurality of ribs each extending outwardly from said inner flow surface, said ribs being spaced from one another to divide the coating material flowing along said inner flow surface into a number of individual streams, said individual streams of coating material being discharged from said atomizing lip of said cup body to form atomized particles of coating material.

10. The apparatus of claim 9 in which said housing includes means for directing air along said outer surface of said cup body toward said atomizing lip.

11. Apparatus for atomizing coating material, comprising:

a cap assembly formed with a wall defining a recess;

a cup body having an outer surface and an inner flow surface which terminates with an atomizing lip and which is adapted to receive coating material, said cup body being rotatably carried within said recess of said cap assembly so that a flow passage is formed between said wall of said recess and said outer surface of said cup body;

a plurality of ribs each extending outwardly from said inner flow surface, said ribs being spaced from one another to divide the coating material flowing along said inner flow surface into a number of individual streams, said individual streams of coating material being discharged from said atomizing lip of said cup body to form atomized particles of coating material;

means for introducing air into said flow passage;

deflector means carried by said cap assembly for directing air onto said outer surface of said cup body to substantially prevent the formation of a vacuum within said flow passage.

12. A method of atomizing coating material, comprising:

directing coating material along the inner surface of a rotating atomizing cup toward an atomizing lip of the cup;

dividing the coating material into individual streams at a location upstream from said atomizing lip and directing said individual streams onto a blow area along said inner surface of said atomizing cup between said upstream location and said atomizing lip where centrifugal force created by said atomizing cup at least partially flattens said individual streams;

discharging said at least partially flattened individual streams from said atomizing lip to form atomized particles of coating material.

13. The method of claim 12 in which said step of dividing the coating material comprises dividing the coating material into individual streams which are maintained at substantially constant pressure prior to discharge from said atomizing lip.

14. A method of atomizing coating material, comprising:

directing coating material into spaces between a number of ribs extending outwardly from the inner surface of a rotating atomizing cup to form a number of individual streams of coating material;

transmitting the individual streams toward the atomizing lip of the cup so that the individual streams are subjected to centrifugal force created by the rotating atomizing cup at a location outside of the space between adjacent ribs;

discharging said individual streams from the atomizing lip of the cup to form atomized particles of coating material.

15. The method of claim 14 in which said step of transmitting the individual streams comprises discharging the individual streams from the spaces between adjacent ribs at a location upstream from the atomizing lip so that centrifugal force created by the rotating atomizing cup at least partially flattens the individual streams prior to discharge from the atomizing lip.

16. A method of atomizing coating material, comprising:

directing coating material along the inner surface of a rotating atomizing cup in a forward direction toward an atomizing lip of the cup;

dividing the coating material into individual streams which flow within spaces formed between a plurality of ribs extending outwardly from said inner surface of said rotating atomizing cup;

directing said individual streams from between adjacent ribs onto a flow area formed along said inner surface between a forward end of said ribs and said atomizing lip where centrifugal force created by said rotating atomizing cup at least partially flattens said individual streams;

discharging said at least partially flattened individual streams from said atomizing lip to form atomized particles of coating material.

17. A rotary atomizer cup for atomizing coating material comprising:

a rotatable cup body including a wall having an outer surface and an inner flow surface which terminates at an atomizing lip, said cup body being adapted to receive coating material which flows along said inner flow surface toward said atomizing lip;

a plurality of ribs each extending outwardly from said inner flow surface, said ribs being spaced from one another to divide the coating material flowing along said inner flow surface into a number of individual streams, each of said ribs terminating upstream from said atomizing lip forming a space therebetween where said individual streams are not confined by adjacent ribs and along which said individual streams are at least partially flattened while remaining divided from one another, said at least partially flattened individual streams of coating material being discharged from said atomizing lip of said cup body to form atomized particles of coating material.

18. The rotary atomizer cup of claim 17 in which said ribs are spaced a distance of about 0.010 inches from one another.

19. The rotary atomizer cup of claim 17 in which said ribs are each about 0.020 inches in width.

20. The rotary atomizer cup of claim 17 in which said ribs each extend a distance of about 0.015 inches outwardly from said inner flow surface.

21. The rotary atomizer cup of claim 17 in which each of said ribs terminates about 0.007 inches upstream from said atomizing lip.

22. The rotary atomizer cup of claim 17 further including means for directing air along said outer surface of said cup body toward said atomizing lip.

* * * * *

UNITED STATES PATENT AND TRADEMARK OFFICE

CERTIFICATE OF CORRECTION

PATENT NO. : 5,078,321

DATED : January 7, 1992

INVENTOR(S) : Dennis Davis and Harold D. Beam

It is certified that error appears in the above-identified patent and that said Letters Patent is hereby corrected as shown below:

On the title page, item (75):

Please correct the first-named inventor from "Dennia Davis" to --Dennis Davis--.

Column 9, line 13, "blow" should be --flow--.

Signed and Sealed this

Seventeenth Day of August, 1993

Bruce Lehman

*Attest:*

BRUCE LEHMAN

*Attesting Officer*

*Commissioner of Patents and Trademarks*